US005833315A

United States Patent [19]

Johnston

[11] Patent Number: 5,833,315

[45] **Date of Patent: *Nov. 10, 1998**

[54] SEAT UPLIFT APPARATUS

[76] Inventor: Gary Lawrence Johnston, P.O. Box 183, Cowarts, Ala. 36321

[ * ] Notice: The term of this patent shall not extend beyond the expiration date of Pat. No. 5,303,982.

[21] Appl. No.: 659,509

[22] Filed: Jun. 6, 1996

Related U.S. Application Data

[63] Continuation-in-part of Ser. No. 456,176, May 31, 1995, abandoned, which is a continuation-in-part of Ser. No. 144,034, Nov. 1, 1993, Pat. No. 5,445,431, which is a continuation-in-part of Ser. No. 759,233, Sep. 13, 1991, Pat. No. 5,303,982.

[51] Int. Cl.[6] ..... A47C 3/32

[52] U.S. Cl. ..... 297/339

[58] Field of Search ..... 297/339, 338, 297/337, DIG. 10, 411.3, 323; 4/560.1, 564.1, 565.1

[56] References Cited

U.S. PATENT DOCUMENTS

| | | | |
|---|---|---|---|
| 459,282 | 9/1891 | Gollon . | |
| 2,788,527 | 4/1957 | Steven . | |
| 2,850,075 | 4/1958 | Wilson . | |
| 3,233,868 | 2/1966 | Harvey et al. . | |
| 4,034,426 | 7/1977 | Hardwick et al. . | |
| 4,888,833 | 12/1989 | Garcia et al. . | |
| 4,907,303 | 3/1990 | Baird . | |
| 4,929,022 | 5/1990 | Geraci . | |
| 5,303,982 | 4/1994 | Johnston | 297/339 |
| 5,445,431 | 8/1995 | Johnston | 297/339 |
| 5,468,049 | 11/1995 | Johnston | 297/339 |

FOREIGN PATENT DOCUMENTS

| | | |
|---|---|---|
| 1435559 | 4/1974 | United Kingdom . |
| 2183150 | 6/1987 | United Kingdom . |

*Primary Examiner*—James R. Brittain

[57] ABSTRACT

A manually operated uplift apparatus comprising a structural frame unit, a mechanical uplift assembly unit, and a power translating mechanism connecting the two units to allow the user to more easily obtain a standing position from a previously seated position. The structural frame unit is used to support and guide the mechanical uplift assembly unit. The mechanical uplift assembly unit has two sections which can independently move vertically with respect to the structural frame unit. One section has a seat, the other has rails or hand engagement handles. When downward force is applied to the hand engagement handles, the section having the handles move vertically downward and produces an upward force in the section having the seat through the power translating mechanism. This interface allows the user to more easily uplift themselves from a seated position and is especially useful for older and/or medically disabled persons.

18 Claims, 7 Drawing Sheets

FIGURE 4C
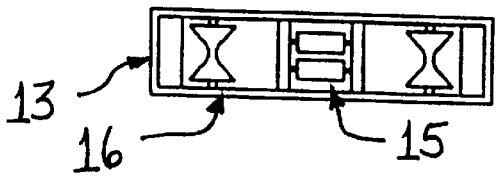
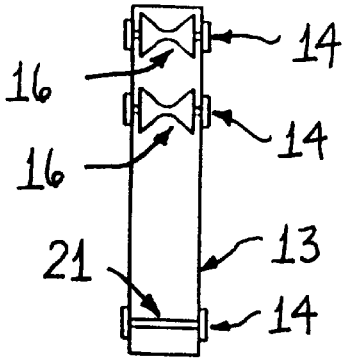
FIGURE 4B
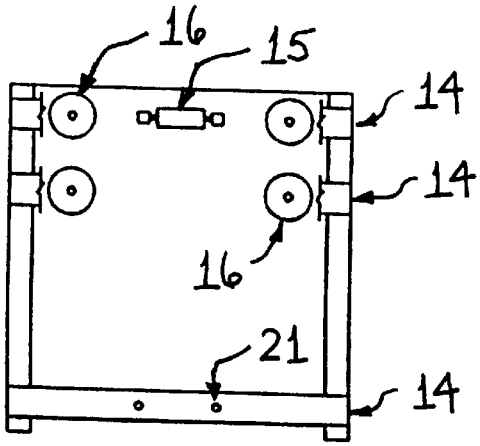
FIGURE 4A
FIGURE 5B
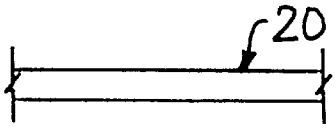
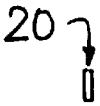
FIGURE 5C
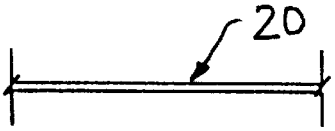
FIGURE 5A

SEAT UPLIFT APPARATUS

CROSS-REFERENCE TO RELATED APPLICATIONS

This application is a Continuation-In-Part of U.S. application Ser. No. 08/456,176, filed May 31, 1995, now abandoned which is Continuation-In-Part of U.S. application Ser. No. 08/144,034, filed Nov. 1, 1993, now U.S. Pat. No. 5,445,431. The U.S. Pat. No. 5,445,431 is itself a Continuation-In-Part of U.S. application Ser. No. 07/759,233, filed Sep. 13, 1991, now U.S. Pat. No. 5,303,982.

BACKGROUND OF THE INVENTION

1. Field of the Invention

The present invention relates to a mechanical sitting device. More particularly, the present invention relates to a sitting device from which the user may mechanically uplift themselves from a seated position to a point where a standing position may be more easily obtained.

2. Description of the Prior Art

Sitting devices designed to assist the user in obtaining a standing position from a previous seated position are known in the art. Conventionally, these sitting devices are relatively expensive, bulky, and weighty, making them difficult to move from place to place. Further, many of these devices use electrical power to uplift the user, therefore requiring proximity to electrical outlets, or the extra weight of batteries.

U.S. Pat. No. 459,282 to Gollon discloses an exercise apparatus which has a frame unit, uplift assembly, vertical support members, structural pulleys, guide elements, a seat member, rail members, a cable member, and a back support. The arrangement and interaction of these elements and the resultant device is unrelated to the present invention.

U.S. Pat. No. 2,788,527 to Steven discloses a bathtub which can be electrically raised and lowered between two walls using rollers and attached mercerized canvas.

U.S. Pat. No. 2,850,075 to Wilson discloses an invalid chair including a vertically adjustable carriage assembly. This carriage assembly is raised and lowered between supports through the use of a sling which can be lengthened or shortened using power means and a crank.

U.S. Pat. No. 4,034,426 to Hardwick et al. discloses a mechanical bath tub lift chair apparatus wherein the user rocks the chair to elevate the seat through a rachet s system.

U.S. Pat. No. 4,888,833 to Garcia et al. discloses a cart for positioning a body on a toilet, having hydraulic means for lifting and lowering a seating means.

U.S. Pat. No. 4,907,303 to Baird discloses an orthopedic chair with a spring loaded pivoting seat.

U.S. Pat. No. 4,929,022 to Geraci discloses a chair, with a spring loaded pivoting seat, having a lifting means comprised of handle bars and a foot operated lever member.

U.K. Patent GB 1,435,559 discloses a chair including a motorized seat which can be raised and lowered without tilting relative to the base.

Published U.K. Patent Application GB 2,183,150 A discloses a chair including a seat which tilts forward when actuated by the user through pivotally attached tilting means.

None of the above inventions and patents, taken either singly or in combination, is seen to describe the instant invention as calimed.

SUMMARY OF THE INVENTION

The present invention comprises a mechanical seat uplift apparatus which includes a sitting device from which the user is uplifted from a seated position by pushing downward upon a set of rails or hand engagement handles, producing downward motion of said rails or hand engagement handles. This downward motion creates upward motion in a seat support member, to achieve a raised position. This raised seat position allows the user to more easily achieve an upright standing position.

Accordingly it is a principal object of the invention to provide a mechanical user-powered seat uplift apparatus which may be easily operated by persons who mormally have difficulty in standing from seated position.

It is another object of the invention to provide sitting devices adaptable to any conventional use of seats, including toilets, wheelchairs, airplane seats, and stationary chairs.

These and other objects of the present invention will become readily apparent upon further review of the following specification and drawings.

BRIEF DESCRIPTION OF THE DRAWING

FIG. 4A is a side view of the structural frame unit of the seat uplift apparatus.

FIG. 4B is a front view of the structural frame unit of the seat uplift apparatus.

FIG. 4C is a top view of the structural frame unit of the seat uplift apparatus.

FIG. 5A is a side view of the power translating mechanism of the mechanical uplift assembly.

FIG. 5B is a front view of the power translating mechanism of the mechanical uplift assembly.

FIG. 5C is a top view of the power translating mechanism of the mechanical uplift assembly.

DETAILED DESCRIPTION OF THE PREFERRED EMBODIMENTS

Figure 1A:
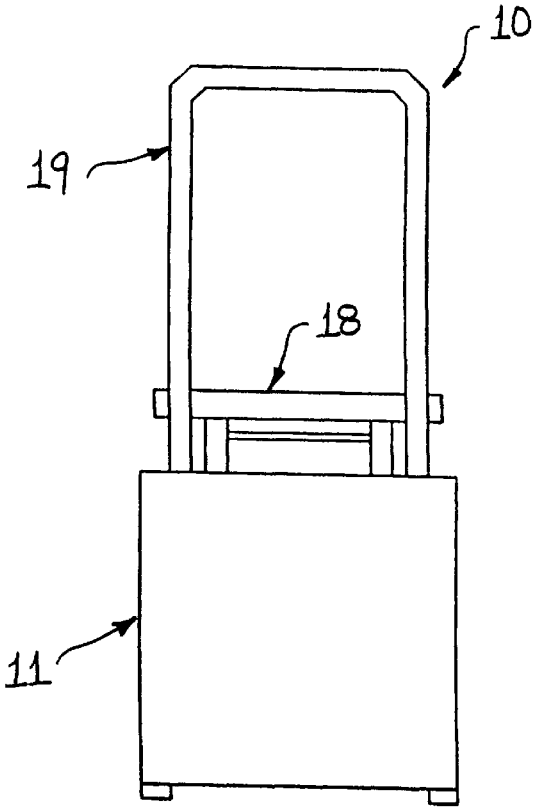
FIG. 1A is a side view of the seat uplift apparatus.
Figure 1B:
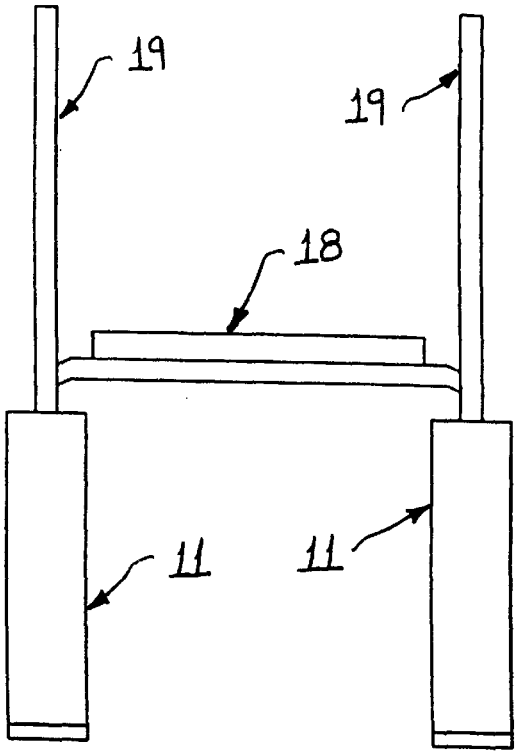
FIG. 1B is a front view of the seat uplift apparatus.
Figure 1C:
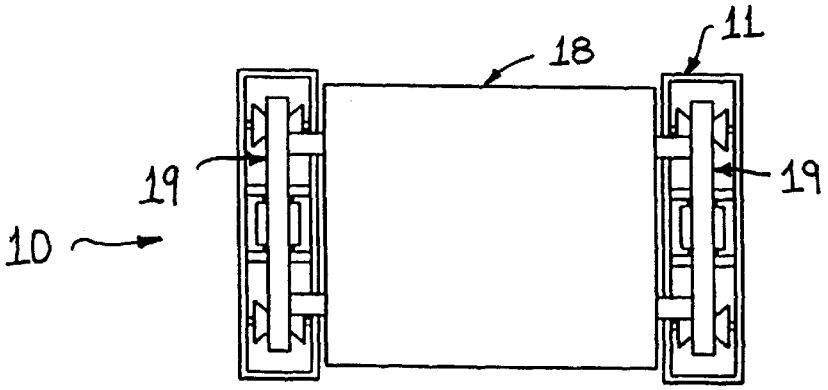
FIG. 1C is a top view of the seat uplift apparatus.
Figure 2C:
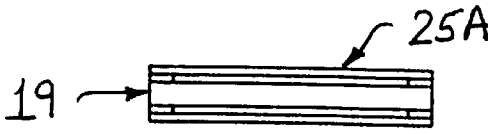
FIG. 2C is a top view of the hand engagement handle of the mechanical uplift assembly.
Figure 2D:
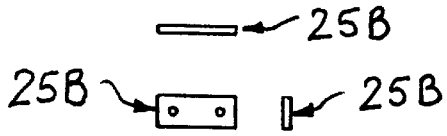
FIG. 2D is a top, front, and side view of a component of the mechanism engagement means for the hand engagement handle.
Figure 2A:
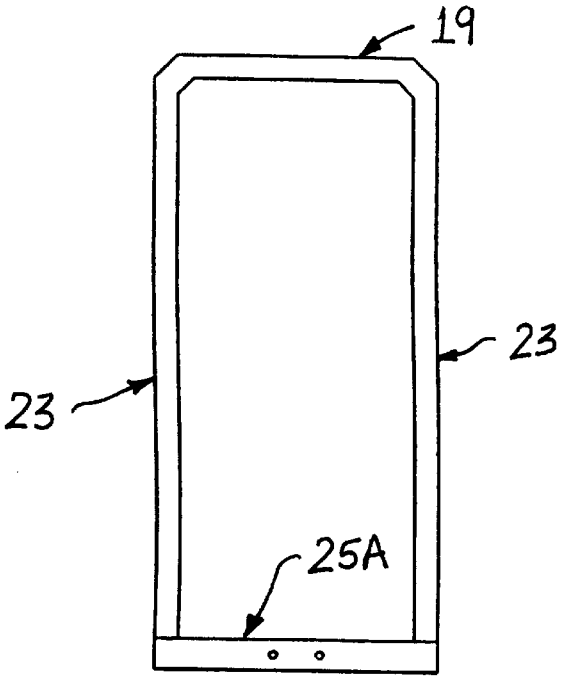
FIG. 2A is a side view of the hand engagement handle of the mechanical uplift assembly.
Figure 2B:
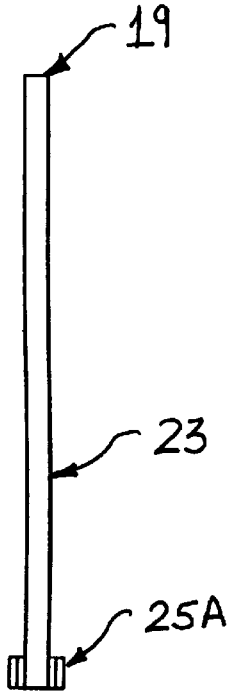
FIG. 2B is a front view of the hand engagement handle of the mechanical uplift assembly.
Figure 3A:
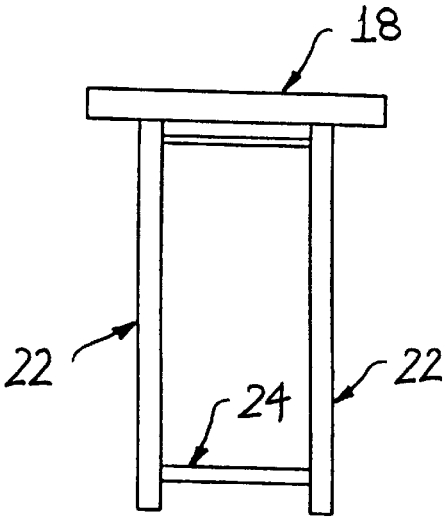
FIG. 3A is a side view of the seat member of the mechanical uplift assembly.
Figure 3B:
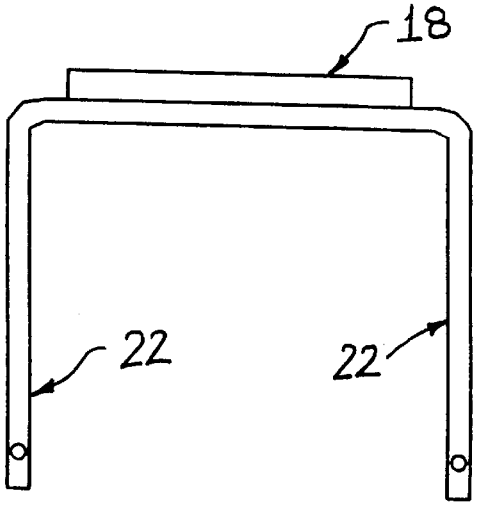
FIG. 3B is a front view of the seat member of the mechanical uplift assembly.
Figure 3C:
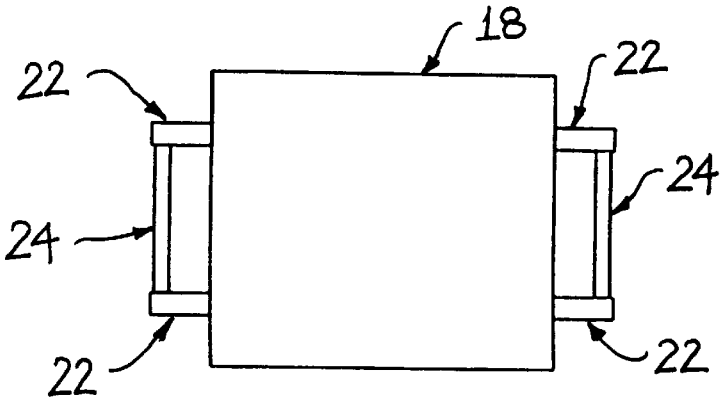
FIG. 3C is a top view of the seat member of the mechanical uplift assembly.

As can be seen by reference to the drawings, and in particular FIGS. 1A–5C, the user-operated seat uplift apparatus that forms the basis of the present invention is designated generally by the reference numeral 10, and comprises a structural frame unit, a mechanical uplift unit, and a power translating mechanism.

The structural frame unit includes a frame 11, composed of vertical support members 13 and horizontal support members 14, mechanism engagement means 15 for engaging the power translating mechanism, and optionally guide elements 16.

The mechanical uplift assembly unit comprises a seat member 18 mounted to a first member 22, which supports the user while the user is trying to move from a substantially horizontal seated position to a raised position, and rails or hand engagement handles 19 disposed on each side of the seat mounted to a second member 23, wherein each member has a mechanism engagement means 25 and 24 respectively, for engaging the power translating mechanism 20, and is moveable in the substantially vertical direction independent of the other member, with respect to the structural frame unit. The mechanical apparatus may optionally further comprise guide elements 16. Since each hand engagement handle 19 operates independent of each other, the user could utilize only one hand engagement handle to uplift themselves, but it will probably prove best to utilize two.

The power translating mechanism 20 operatively connects said first member, said second member, and said frame through their respective mechanism engagement means such that the downward force on said rails or hand engagement handles translates to upward force on said seat member.

The frame of the structural frame unit comprises vertical support members 13 and horizontal support members 14. The frame may optionally further comprise side plates 17. Said vertical support members and said horizontal support members together form a rigid structure. This may be accomplished by any appropriate arrangement such as a unitary construction, jointed construction between said horizontal support members and said vertical support members, or braced construction between said horizontal support members and said vertical support members.

The mechanism engagement means 15 of the structural frame unit may be grooves, sleeves, brackets, pins, or hooks therein. Alternatively, the mechanism engagement means is attached to the frame and may further incorporate separately moveable parts, such as pulleys, wheels, gears, glides, grips, and rollers. Preferred mechanism engagement means of the structural frame unit include pins, sleeves, pulleys, or holes. For example, in FIGS. 6A and 6B, the structural frame unit comprises vertical supports members 13 attached to two horizontal supports members 14 of the frame 11. Therein the mechanism engagement means 15 are rollers mounted to vertical support members 13.

The optional guide elements 16 of the structural frame unit may also be a structural feature of said frame 11 or, alternatively, are attached to said frame and may optionally further comprise rollers or a low friction coating. These guide elements receive vertical support elements of the mechanical uplift unit. Preferred guide elements are grooved rollers. For example, in FIGS. 6A and 6B, the vertical support elements are round tubing which move within the circular grooves of the rollers. The rollers guide the vertical support elements in the substantially horizontal direction, most of the time rolling simultaneous with the movement of the vertical support elements.

Figure 7:
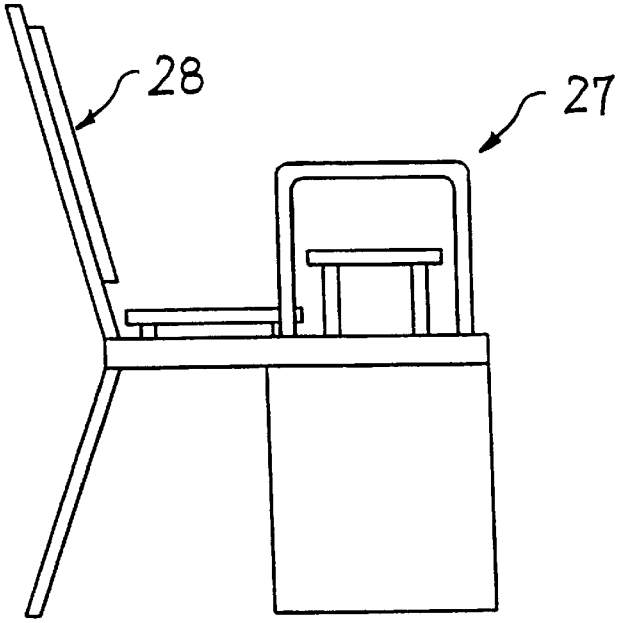
FIG. 7 is a side view of a chair incorporating an embodiment of the present invention.
Figure 8:
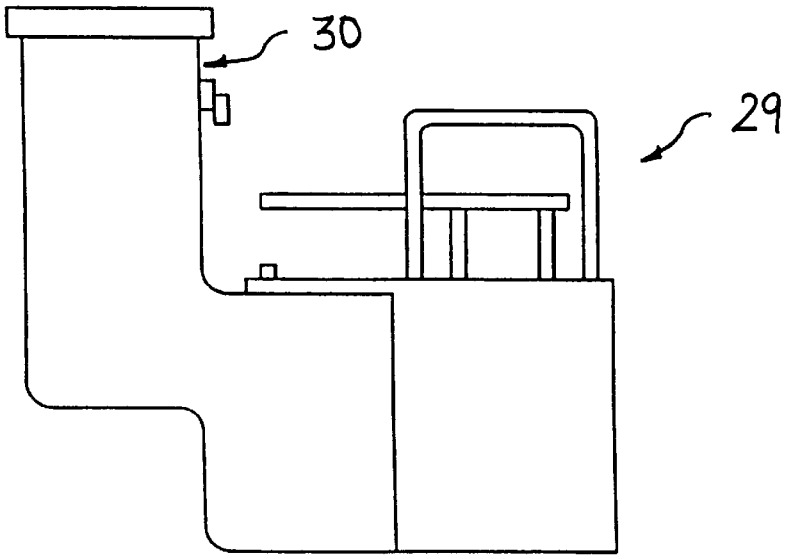
FIG. 8 is a side view of a toilet incorporating an embodiment of the present invention.
Figure 9:
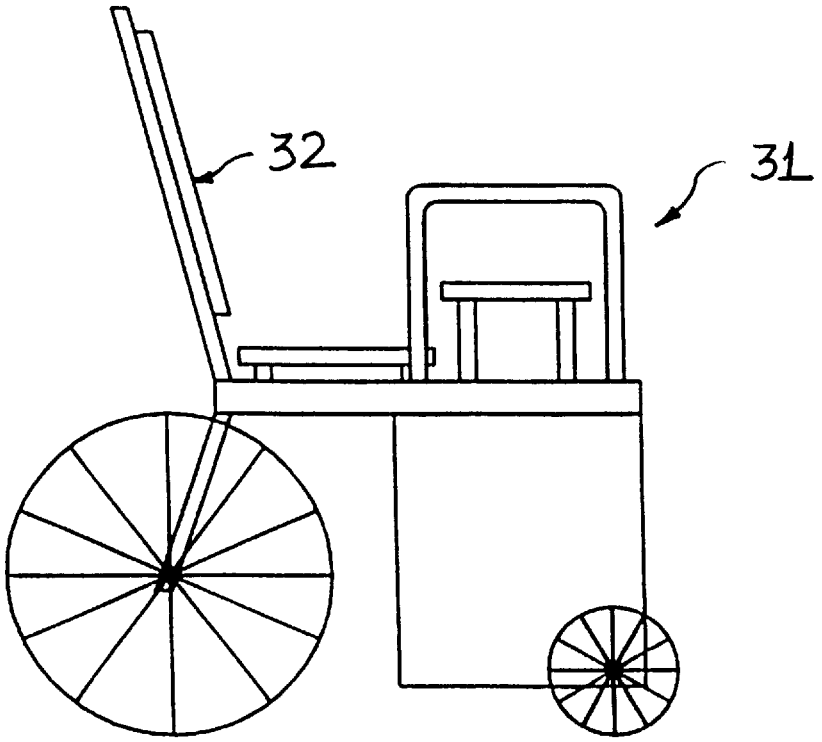
FIG. 9 is a side view of a wheelchair incorporating an embodiment of the present invention.

The seat member 18 of the mechanical uplift assembly unit has appropriate features for the intended use of the present device. For example, when the present device is incorporated into a toilet, such as shown in FIG. 8, the convention features of a toilet seat, such as a centarl void, are incorporated. A back support may be attached to the seat member, as shown in FIGS. 7 and 9, and may move upward with the seat member, or remain stationary as shown in FIGS. 7 and 9. The seat member 18 may be the entire seat, as shown in FIG. 8, or a protion of the seat, as also shown in FIGS. 7 and 9. The seat is preferrably made of lightweight materials such as cloth, lightweight metals, plastic, or combinations thereof.

Said seat member 18 is mounted to a first member 22, which comprises at least one substantially vertical support element of substantially constant horizontal dimension, and means for supporting said seat member. Said means for supporting said seat member are any appropriate means which fixedly attach seat member 18 to said first member 22, including adhesive, brackets and screws, or the like. Preferrably said first member comprises two or more vertical support elements. The vertical support elements and the means for supporting said seat support member are arranged by any appropriate manner, such as unitary construction, jointed construction, or the like, such that the first member is substantially rigid. The first member comprises a mechanism emgagement means 24, which may be of the same type used in the structural frame unit, may be a structural feature of said first member, or may be separately attached.

Rails or hand engagement handles 19 are displosed on each side of said seat which are mounted to a second member 23, wherein said second member comprises at least one substantially vertical support element of substantially constant horizontal dimension. The second member is rigidly connected to horizontal component 25A, which is substantially rigid and may be considered part of the mechanism engagement means. Another part of the mechanism engagement means may be separately attached component 25B.

The power translating mechanism 20 operatively connects said first member, said second member, and said frame through their respective mechanism engagement means such that the downward force on said rails or hand engagement handles 19 translates to upward force on said seat member 18. This may be accomplished through various power transfer schemes. Preferrably, the power transfer mechanism comprises a linkage system utilizing a belt or tether. As shown in FIGS. 5A–6B said belt or tether 20 operatively connects: the first member 22 through mechanism engagement means of the structure type 24, the second member 23 through horizontal support 25A and attached component 25B, and the frame 11 through rollers or pulleys 15. Different configurations may be used to produce different ratios of first member travel and second member travel, in the vertical direction. The invention has the advantage of utilizing other embodiments of power transfer mechanisms and mechanism engagement means which are available in the art, so long as the transfer of downward motion in the second member is translated to the upward motion of the first member.

It is desireable that the seat member 18, which is attached to said first member 22, maintain a substantially horizontal position throughout said upward motion of said first member. This may be accomplished by having the frame and first member sized so that movement of said first member is restricted to the vertical direction, being confined by the frame.

Figure 6A:
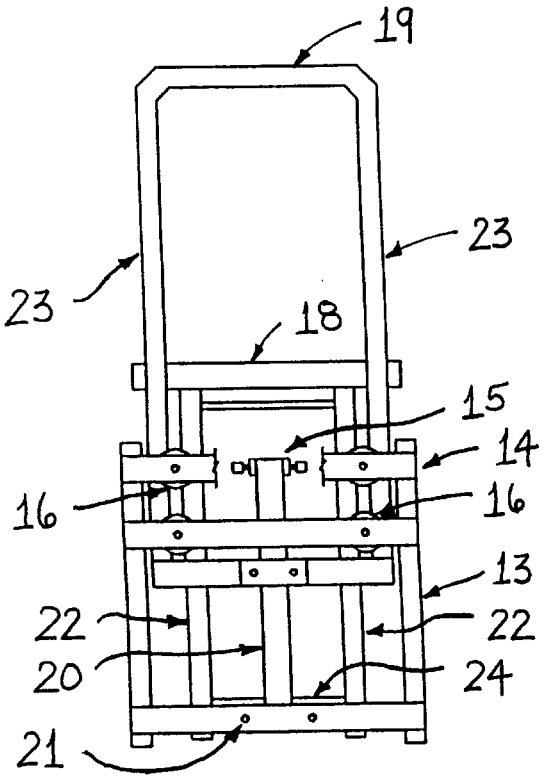
FIG. 6A is a side view of the seat uplift apparatus, before being engaged by the user.
Figure 6B:
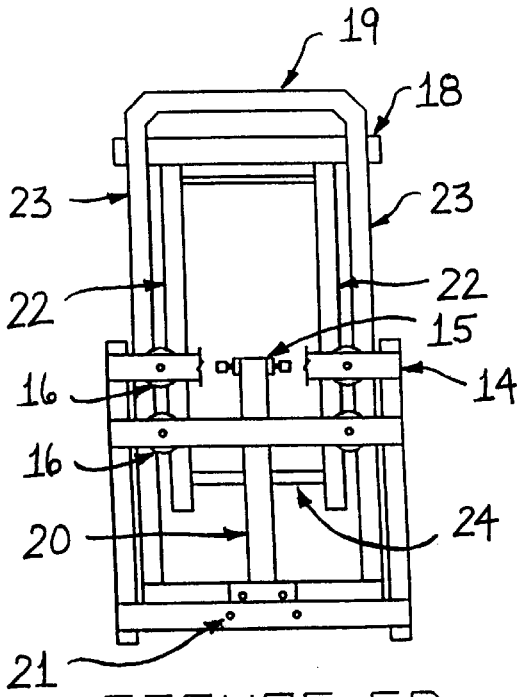
FIG. 6B is a side view of the seat uplift apparatus, after being engaged by the user.

With reference to the drawings, FIGS. 6A and 6B demonstrate the operation of the apparatus. As seen, the first member 22 and the second member 23 are guided in a substantially vertical direction by guide elements 16. Guide elements 16 are grooved rollers which roll when in contact with any part of the first and second member, although some sliding will also occurr. These not only guide the first and second member, but also make movement much smoother.

The user will push downward upon hand engagement handle 19, causing the hand engagement handle 19, along with the second member 23, to move downward. A power translating mechanism 20, which is simply a belt or tether, operatively connects the mechanism engagement means of the frame, first member, and second member. The belt is connected at one end to the second member by horizontal component 25A and attached component 25B. Attached component 25B is secured to horizontal component 25A through a securing means, such as a bolt, rivet, weld, etc. The end of the belt is squeezed between the two components, which keeps the belt secured. The belt extends upward and over one of the rollers or pulleys, which are part of the mechanism engagement means 15 for the frame. The belt then extends downward and underneath the mechansim engagement means 24 for the first member 22. The belt then extends back upward and over the second roller for mechanism engagement means 15. The belt then extends downward, where it attaches again to the horizontal component and attached component mounted on the other side of second member 23. Therefore, the configuration of the belt is such that downward motion in the hand engagement handle 19 will produce upward motion in seat member 18.

As may be seen in FIGS. 7, 8, and 9, the instant apparatus may be incorporated into sitting devices of various types, thereby allowing users of these types of devices to benefit from the advantages of the present invention. Optional attachments appropriate to the use of these sitting devices may be further attached, such as wheels 33 in the wheelchair 31, toilet tank 30 in toilet 29, and cushions in chair 27.

It is understood that the present invention is not limited to the sole embodiment described above, but encompasses any and all embodiments within the scope of the following claims.

I claim:

1. A seat uplift apparatus comprising:

a frame having a frame mechanism engagement means;

a seat having a seat mechanism engagement means, said seat mechanism engagement means moveable in the upward and downward directions with respect to said frame;

a hand engagement handle having a handle mechanism engagement means, said handle mechansim engagement means moveable independently of said seat mechanism engagement means in the upward and downward directions with repect to said frame;

a power translating mechanism operatively connecting said seat mechanism engagement means, said handle mechanism engagement means, and said frame mechanism engagement means for translating the downward force applied by the user on said hand engagement handle into an upward force on the seat, thereby lifting the user into a raised position;

wherein said power translating mechanism is a tether, said seat mechanism engagement means, said handle mechanism engagement means, and said frame mechanism engagement means engaging said tether such that said tether operatively connects said seat, said hand engagement handle, and said frame.

2. The seat uplift apparatus as claimed in claim 1, said seat being mounted to a first member, said seat mechanism engagement means being mounted to said first member; and said hand engagement handle being mounted to a second member, said handle mechanism engagement means being mounted to said second member.

3. The seat uplift apparatus as claimed in claim 2, said first member comprising at least one elongated seat support member connected to and extending downward from said seat and being coupled to said frame to move in the upward and downward directions.

4. The seat uplift apparatus as claimed in claim 3, said frame comprising at least one guide member adapted to receive said seat support member and guiding said seat support member to move in the upward and downward directions with respect to said frame.

5. The seat uplift apparatus as claimed in claim 4, said guide member including a grooved roller turnably mounted on said frame, said grooved roller sized to contain and guide said elongated seat support member as it moves along a portion of its groove.

6. The seat uplift apparatus as claimed in claim 2, said second member comprising at least one elongated handle support member connected to and extending downward from said hand engagement handle and being coupled to said frame to move in the upward and downward directions.

7. The seat uplift apparatus as claimed in claim 6, said frame comprising at least one guide member adapted to receive said handle support member and guiding said handle support member to move in the upward and downward directions with respect to said frame.

8. The seat uplift apparatus as claimed in claim 7, said guide member including a grooved roller turnably mounted on said frame, said grooved roller sized to contain and guide said elongated handle support member as it moves along a portion of its groove.

9. The seat uplift apparatus as claimed in claim 1, said seat mechanism engagement means engaging said tether of said power translating mechanism, said handle mechanism engagement means also engaging said tether, said frame mechanism engagement means being pulleys upon which said tether moves, said tether thus operatively connecting said seat mechanism engagement means, said handle mechanism engagement means, and said frame mechanism engagement means.

10. A seat uplift apparatus comprising:

a frame having a frame mechanism engagement means;

a seat having a seat mechanism engagement means, said seat mechanism engagement means moveable in the upward and downward directions with respect to said frame;

two hand engagement handles located on opposite sides of said frame, each hand engagement handle having a handle mechanism engagement means, said handle mechansim engagement means moveable independently of said seat mechanism engagement means in the upward and downward directions with repect to said frame;

a power translating mechanism operatively connecting said seat mechanism engagement means, said handle mechanism engagement means, and said frame mechanism engagement means for translating the downward force applied by the user on said hand engagement handle into an upward force on the seat, thereby lifting the user into a raised position.

11. The seat uplift apparatus as claimed in claim 10, said seat being mounted to a first member, said seat mechanism engagement means being mounted to said first member; and said hand engagement handle being mounted to a second member, said handle mechanism engagement means being mounted to said second member.

12. The seat uplift apparatus as claimed in claim 11, said first member comprising at least one elongated seat support member connected to and extending downward from said seat and being coupled to said frame to move in the upward and downward directions.

13. The seat uplift apparatus as claimed in claim 12, said frame commprising at least one guide member adapted to receive said seat support member and guiding said seat support member to move in the upward and downward directions with respect to said frame.

14. The seat uplift apparatus as claimed in claim 13, said guide member including a grooved roller turnably mounted on said frame, said grooved roller sized to contain and guide said elongated seat support member as it moves along a portion of its groove.

15. The seat uplift apparatus as claimed in claim 11, said second member comprising at least one elongated handle support member connected to and extending downward from said hand engagement handle and being coupled to said frame to move in the upward and downward directions.

16. The seat uplift apparatus as claimed in claim 15, said frame comprising at least one guide member adapted to receive said handle support member and guiding said handle support member to move in the upward and downward directions with respect to said frame.

17. The seat uplift apparatus as claimed in claim 16, said guide member including a grooved roller turnably mounted on said frame, said grooved roller sized to contain and guide said elongated handle support member as it moves along a portion of its groove.

18. The seat uplift apparatus as claimed in claim 10, wherein said power translating mechanism is a tether, said seat mechanism engagement means, said handle mechanism engagement means, and said frame mechanism engagement means engaging said tether, such that said tether operatively connects said seat, said hand engagement handle, and said frame.

* * * * *